US006742354B1

(12) United States Patent
Watts

(10) Patent No.: US 6,742,354 B1
(45) Date of Patent: Jun. 1, 2004

(54) COSMETIC CASE

(76) Inventor: Susan Watts, 1910 E. 166$^{th}$ Dr., Thornton, CO (US) 80602

( * ) Notice: Subject to any disclaimer, the term of this patent is extended or adjusted under 35 U.S.C. 154(b) by 0 days.

(21) Appl. No.: 10/300,718

(22) Filed: Nov. 20, 2002

(51) Int. Cl.$^{7}$ ..... F25D 3/08; F25B 21/00; F17C 13/00

(52) U.S. Cl. ..... 62/457.2; 62/457.1; 62/457.9; 62/371

(58) Field of Search ..... 62/457.9, 457.2, 62/379

(56) References Cited

U.S. PATENT DOCUMENTS

| | | | | |
|---|---|---|---|---|
| 4,892,226 | A | | 1/1990 | Abtahi |
| 5,163,457 | A | | 11/1992 | Lombardi, Jr. |
| 5,237,838 | A | * | 8/1993 | Merritt-Munson ..... 62/457.2 |
| 5,361,603 | A | * | 11/1994 | Merritt-Munson ..... 62/457.2 |
| 5,988,879 | A | * | 11/1999 | Bredderman et al. ..... 383/13 |
| 6,021,642 | A | | 2/2000 | Guinn |

OTHER PUBLICATIONS

Smith et al., Temperature Controlled Shipping Containers, Jan. 23, 2003, US PGP, p. 17.*

* cited by examiner

*Primary Examiner*—William C. Doerrler
*Assistant Examiner*—Filip Zec
(74) *Attorney, Agent, or Firm*—Patton Boggs LLP

(57) ABSTRACT

A compact cosmetic case, including a carrying case and a refrigerable device, for refrigerated storage and transportation of heat-sensitive cosmetics. The cosmetic case includes a narrow cavity that is defined by two attached non-absorbent protective panels, each panel including an insulating material to decrease heat transfer between the outside ambient air and the cavity of the carrying case, where the cosmetics are stored. The arrangement of the cosmetic case keeps cosmetics in close proximity to the refrigerable device and the non-absorbent panels, thereby decreasing the void space within the cavity. The cosmetic case includes a divider that efficiently organizes the cosmetics and the refrigerable devices within the cavity of the carrying case of the cosmetic case.

18 Claims, 2 Drawing Sheets

COSMETIC CASE

FIELD OF THE INVENTION

This invention generally relates to a portable cosmetic case and more specifically concerns a portable cosmetic case having a compact carrying case and refrigerable device that reduces or avoids melting problems associated with the exposure of cosmetics to heated environments.

PROBLEM

Many conventional cosmetic products, such as lipsticks, lip balms facial foundations, contain a base material which is generally a wax-like, cream-like or petroleum based substance. These substances are generally heat sensitive, meaning they become more liquid like when exposed to heat. When these substances are subjected to heat they become undesirably messy and unusable by the user. These cosmetic products can become subjected to heat when a user is storing or transporting these products in warm climates. There are known in the prior art, devices that attempt to solve this problem of storing and transporting cosmetic products while in warm climates.

Some of these known prior art devices are large sized and use bulky removable refrigerated liners, which enables a user to carry large amounts of a sundry of cosmetics, but that have inherently large void spaces between the cosmetics and the carrying case liner. These large void spaces require large bulky refrigerated liners to keep the void space and the cosmetics refrigerated. Oftentimes a user desires to carry a few cosmetic products, such as lipstick or lip balm, because of increased mobility or activity, such as traveling to and from the swimming pool, golf course or tennis court. The prior art devices are not designed to satisfy this need to easily store and transport, under refrigerated conditions, a few smaller cosmetic products in a compact case.

Users with active lifestyles don't wish to tote or carry another large bag, in addition to their purse, golf bag or tennis bag. There is a need for a smaller compact refrigerated cosmetic case that slips into a purse, golf bag or tennis bag, thereby eliminating another bulky bag to carry around. Presently, these prior art bulky devices are not designed to fit into a users purse or other personal carrying container, such as a golf bag or tennis bag.

In addition, these prior art bulky devices inherently are thermodynamically inefficient, because, among other reasons, they include large openings that allow large amounts of ambient temperature air to enter into the cosmetic cooler, thereby increasing the temperature within the bag, each time a user opens the bag to access the interior of the cosmetic product. Once this ambient air enters the known devices the large void space is heated up as well, which creates a greater load on the refrigerating device employed. This is thermodynamically inefficient.

It is more thermodynamically efficient when the cosmetics are generally in direct contact or close proximity with the cooling apparatus, such as a freezable packet or liner, however most known cosmetic coolers place the cosmetics loose in large tote-sized bags that have cooling devices around the perimeter of the bags and therefore the cosmetics and cooling devices do not directly contact each other. Therefore, these prior art devices waste much of their cooling capacity, cooling void spaces within the coolers. This large void space requires large refrigerable liners to chill the cosmetics and the inherent void space.

There are known prior art devices that include large bulky cooling liners that are folded to conform to the inside perimeter of the large tote-sized bag. These can take up more space than desired in a users freezer when freezing the liquid contained in the cooling devices. In addition, they are cumbersome to remove from and place into the carrying bag. Further, these large bulky cooling liners add significant amount of weight to the tote-sized bag.

Information relevant to attempts to address these problems can be found in U.S. Pat. No. 4,892,226 issued Jan. 9, 1990 to Abtahi; U.S. Pat. No. 6,021,642 issued Feb. 8, 2000 to Guinn; and U.S. Pat. No. 5,163,457 issued Nov. 17, 1992 to Lombardi, Jr. However, each one of these references suffers from one or more of the following disadvantages: bulky storage compartment, large void spaces or clumsy large cooling devices.

For the foregoing reasons, there is a need for a small compact cosmetic carrier that has little or minimal void space between the cosmetic and cooling device with small easy to freeze cooling devices and that are compact enough to be able to be carried easily or stored in a user's purse or other carrying bag, without being another article to be carried separately, like a purse, portable chair or umbrella.

SOLUTION

The above-described problems are solved and a technical advance achieved by the present invention by using a carrying case that includes two panels that are attached to each other thereby creating a compact thermodynamically efficient cavity for the cooling of cosmetics, such as lipstick and lip balm for active users.

In particular, the present invention includes two panels that are each constructed of two layers of a protective material and an insulating material layer located between the two layers of protective material of each panel, to create a sleek slim width carrying case. Further, the panels are attached or folded together around most of their common perimeter to create a compact design that keeps the cosmetics contained in close proximity to the refrigerable device and insulated panels, thereby creating a compact case that has a truly thermodynamically efficient design and that can be carried within a purse, tote, golf bag or tennis bag. Part of the novel compact design of the present invention is that it provides for minimal void space.

The present invention provides minimal void space within the cosmetic case, so the cooling source does not waste cooling capacity to large void spaces within the cosmetic case. In particular, the present invention's compact design allows for the insertion of cosmetics between the two panels to create a snug fit between the cosmetics and the insulated panels. Further, void space is almost reduced to zero, due to the fact that the panels normally collapse back on themselves due to the compact design. Therefore, the user can fill or partially fill the cosmetic case with cosmetics and where there would normally be void space with prior art devices, the present invention provides panels that collapse together thereby, eliminating the need to waste cooling capacity to chill the void space. The present invention further provides a compact refrigerable device that is easy to handle and refrigerate.

The novel present invention further includes a refrigerable device that is compact and is easy to remove from and place into the carrying case. The refrigerable device is shaped to fit into the carrying case's design, thereby adding refrigeration capabilities to the cosmetic case without denigrating its compact and thermodynamically efficient shape. The refrigerable device is smaller than prior art devices and is easily and unobtrusively stored in a user's freezer.

The above and other features of present invention can be better understood from a reading of the detailed description and the following drawings.

DETAILED DESCRIPTION

Layout of the Cosmetic Case

Figure 1:
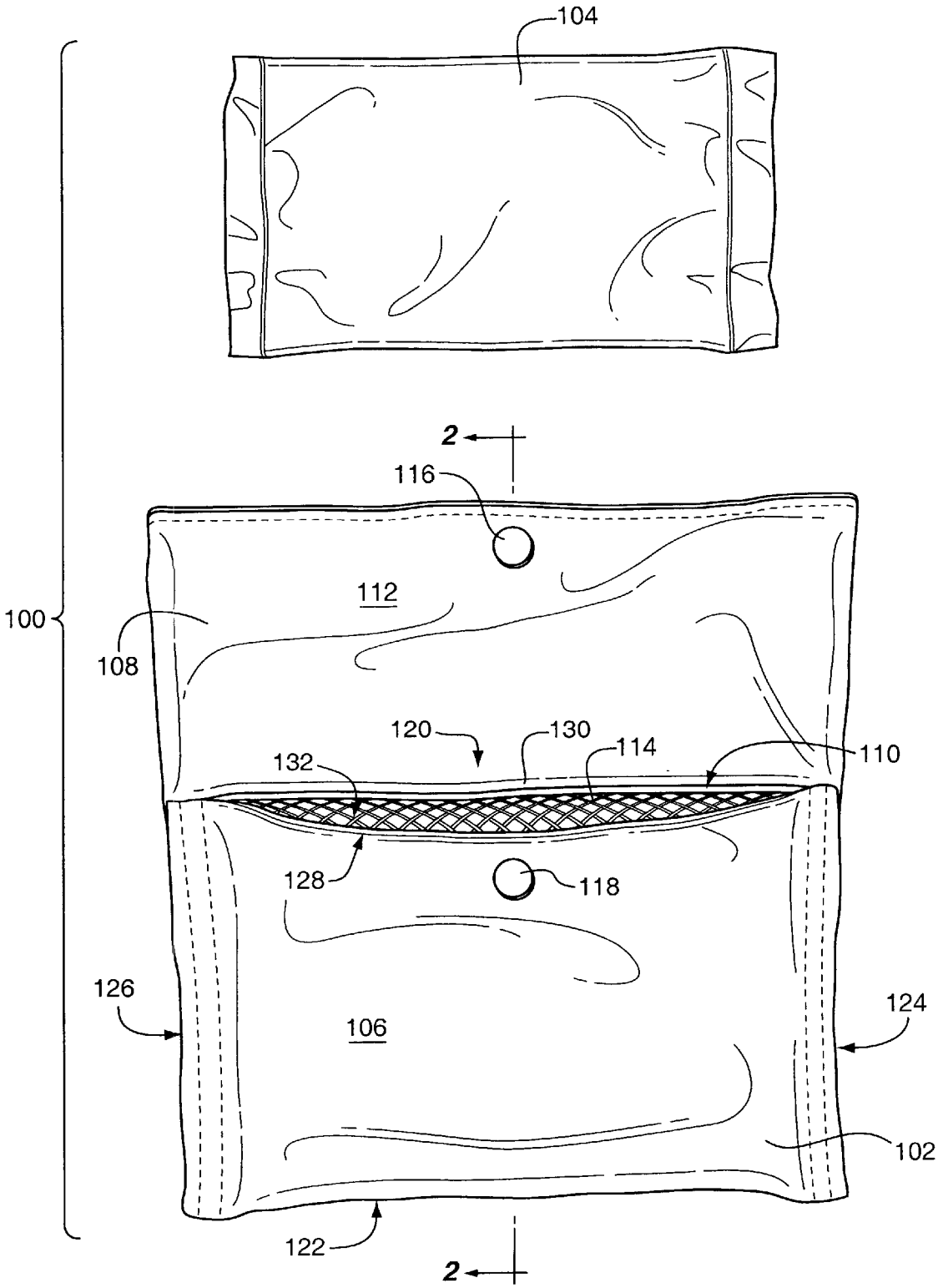
FIG. 1 illustrates a perspective view of the cosmetic case showing the carrying case and the refrigerable device.

FIG. 1 illustrates the cosmetic case 100. Cosmetic case 100 includes a carrying case 102 and a refrigerable device 104. The refrigerable device 104 is removable from the carrying case 102 for placement in a freezer or other refrigeration appliances. The carrying case 102 includes a first non-absorbent panel 106 and a second non-absorbent panel 112 that are attached or folded together along the bottom perimeter 122, and attached on the right side perimeter 124 and left side perimeter 126 to create an opening 120 and a cavity 110 within the carrying case 102 for holding cosmetics, including lipstick containers, such as A in FIG. 2. An upper perimeter 128 of the carrying case 102 defines a part of the opening 120. The opening 120 is also defined by the second non-absorbent panel 112.

The second non-absorbent panel 112 includes a closure flap 108, which is an extension of the second non-absorbent panel 112 and that encloses the cavity 110 of the carrying case 102 by folding over the opening 120 and cavity 110 and attaches to the front panel 106 by closure flap device 116 and first non-absorbent panel closure device 118. The carrying case 102 also includes a divider 114 that is located within the cavity 110 of the carrying case 102. The divider 114 is attached to the left side perimeter 126 and right side perimeter 124 of the carrying case 102. Also, the divider 114 may be attached to the second non-absorbent panel 112 at interim locations to define at least one refrigerable device storage area 130 for holding more than one refrigerable device 104. Further, the divider 114 also defines at least one cosmetic storage area 132 for the placement of cosmetics, such as A in FIG. 2. The cosmetic case 100 may be made of varying sizes to fit the needs of a user.

The height of carrying case 102, when the is closure flap 108 is attached to the first non-absorbent panel 106, is between 1 and 8 inches, and preferably between 3 and 6 inches. Further, the width of the carrying case 102 is between 2 and 12 inches, and preferably 4 and 10 inches. When the closure flap 108 is fully extended the height of the carrying case 102 is between 3 and 12 inches, and preferably between 5 and 9 inches.

The closure flap 108 is an extension of the second non-absorbent panel 112 and is long enough to enclose the contents of the cavity 110 and attach to the first non-absorbent panel 106. Since the closure flap 108 is an extension of the second non-absorbent panel 112, it includes the same construction of protective material layers and insulating material layers as the second non-absorbent panel 112. In one embodiment, the second non-absorbent panel 112 is longer than the first non-absorbent panel 106, whereby the extra length of the second non-absorbent panel 112 comprises the closure flap 108. The closure flap includes a closure flap device 116. The closure flap device 116 and the first non-absorbent panel closure device 118 may be different or may be the same device. Generally, the closure flap device 116 and the first non-absorbent panel closure device 118 are the same type of device such as Velcro, or alternatively other such devices such as zippers, buttons, buckles, laces, snaps or grommets. The types and number of such devices are only limited by the size of the carrying case 102.

Figure 2:
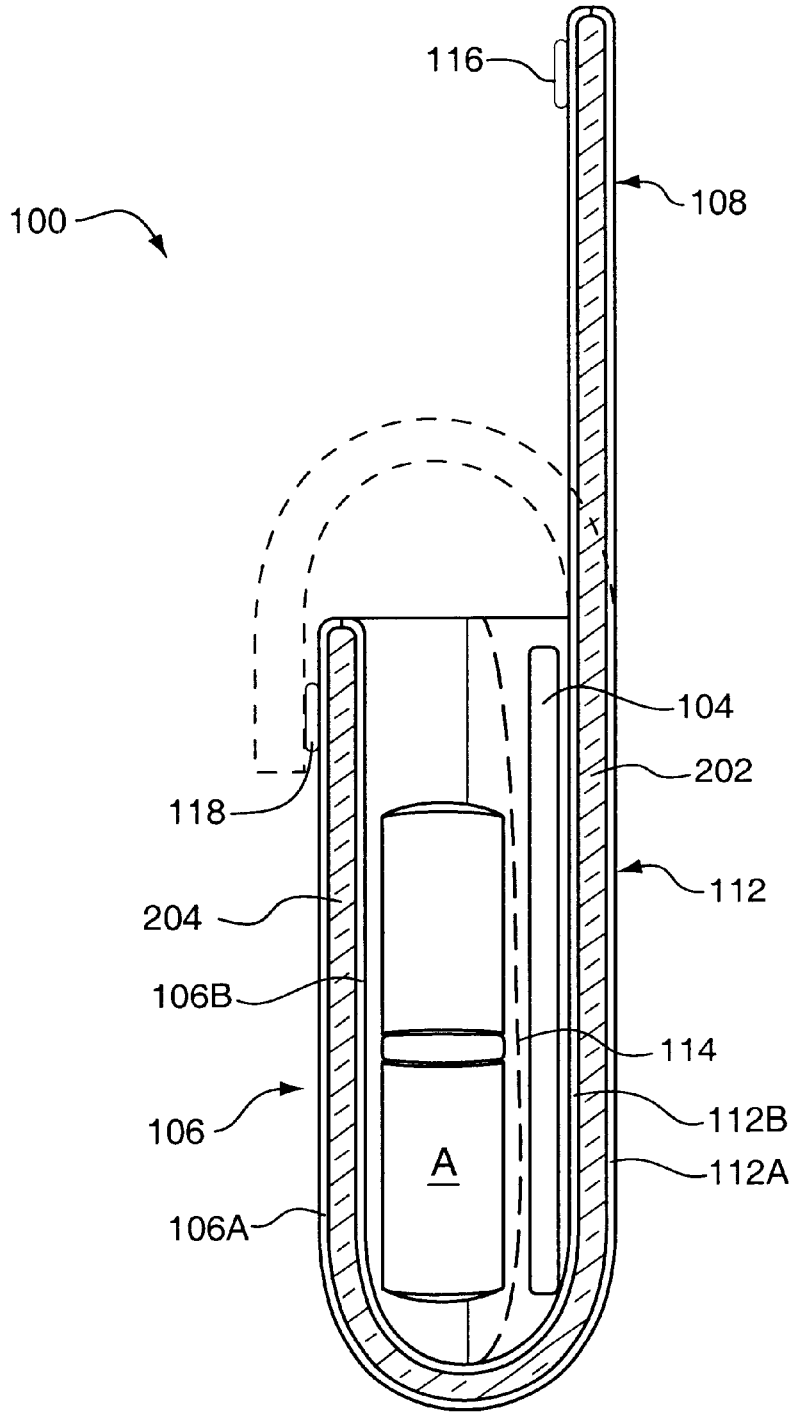
FIG. 2 illustrates a cross-section view of the cosmetic case of FIG. 1 through 2—2.

Directing attention to FIG. 2 is shown the cosmetic case 100 in a cross-section view. The first non-absorbent panel 106 includes a first inner protective material layer 106B and a first outer protective material layer 106A. A first insulating material layer 204 is located between the first inner protective material layer 106B and the first outer protective material layer 106A. The second non-absorbent panel 112 includes a second inner protective material layer 112B and an second outer protective material layer 112A. A second insulating material layer 202 is located between the second inner protective material layer 112B and the second outer protective material layer 112A. The novel arrangement of the first non-absorbent panel 106 and the second non-absorbent panel 112 enable the efficient thermodynamics within the cosmetic case 100.

The first non-absorbent panel 106 and second non-absorbent panel 112 are in close proximity to each other to create a snug fit between the cosmetic, such as A in FIG. 2 and the first non-absorbent panel 106 and the second non-absorbent panel 112. The cosmetic storage area 132 is located between the divider 114 and the first non-absorbent panel 106. More specifically, the cosmetic storage area 132 is located between the divider 114 and the first inner protective material layer 106B. The novel construction of the carrying case 102 permits this snug and thermodynamically efficient design.

The first non-absorbent panel 106 and the second non-absorbent panel 112 are attached or folded along the right side perimeter 124, the left side perimeter 126 and the bottom perimeter 122. The attachment can be stitching that is commonly used by those skilled in the art, or alternatively by other such attachment methods such as glue, hot glue, binders, epoxies, sewing, riveting or stapling. The entire length of the right side perimeter 124 is generally attached together to form a seam that runs the length from the bottom perimeter 122 to the upper perimeter 128. In addition, the entire length of the left side perimeter 126 is generally attached together to form a seam that runs the length from the bottom perimeter 122 to the upper perimeter 128. The bottom perimeter 122 may be formed by folding the second non-absorbent panel 112 or attached as described above.

In one embodiment of the present invention, the first non-absorbent panel 106 and the second non-absorbent panel 112 are separate panels. In another embodiment, as would be known to one skilled in the art, one long panel including an inner and outer protective material layer including an insulating material layer therebetween, could be folded in half, where the fold would define the bottom perimeter 122 and the first non-absorbent panel 106 and the second non-absorbent panel 112 would be defined by each half of the folded material. These embodiments are for purposes of constructing the present invention and not to limit in any way the inventive concept claimed herein.

The first non-absorbent panel 106 comprises a first inner protective material layer 106B and a first outer protective material layer 106A. The second non-absorbent panel 112 comprises a second inner protective material layer 112B and a second outer protective material layer 112A. The first inner protective material layer 106B and the second inner protective material layer 112B both face inward and towards the cavity 110. Conversely, the first outer protective material layer 106A and the second outer protective material layer 112A face outward and away from the cavity 110. The inner protective material layers 106B and 112B may be made of the same or a different material as the outer protective material layers 106A and 112A. The inner and outer protective material layers, 106A, 106B, 112A and 112B may be made of nylon, or alternatively other non-absorbent materials such as polyester, Gortex, rubber, vinyl, plastic or canvas. These non-absorbent protective materials help keep the integrity of the insulating material of the carrying case 102 and the cosmetics dry and intact.

The first non-absorbent panel 106 comprises a first insulating material layer 204 located between the first inner protective material layer 106B and the first outer protective material layer 106A. Also, the second non-absorbent panel 112 comprises a second insulating material layer 202 located between the second inner protective material layer 1 12B and the second outer protective material layer 112A. The first insulating material layer 204 and the second insulating material layer 202 are made of an insulating material such as Thinsulate, or alternatively other insulating material such as Polartec, cotton, wool or polyester. The thickness of the insulating material layers 204 and 202 are between 0 and 1.5 inches, and preferably between 0.1 and 0.5 inches. The height and width of the first insulating material layer 204 are equal to or just slightly smaller than the dimensions of the first non-absorbent panel 106. In addition, the height and width of the second insulating material layer 202 are equal to or just slightly smaller than the dimensions of the second non-absorbent panel 112. Also of equal of just slightly smaller dimensions than the first non-absorbent panel 106 is the divider 114.

The divider 114 may be located and affixed to the case in various arrangements. In one embodiment, the divider 114 is attached to the right side perimeter 124 and spans the width of the cavity 110 where it is attached to the left side perimeter 126 of the cavity 110. In this embodiment, the divider 114 defines one refrigerable device storage area and one refrigerable device 104 can be inserted that may span the full or partial width of the cavity 110. In another embodiment, the divider 114 is attached to the right side perimeter 124 and spans the width of the cavity 110 where it is attached to the left side perimeter 126, in addition it is attached to the second non-absorbent panel 112 at intervals, thereby defining several individual refrigerable device storage areas, whereby one or more refrigerable devices 104 can be inserted.

The divider generally spans the height of the cavity 110, but it may also be partially span the height of the cavity 110. The divider 114 may made of an assortment of material such as nylon webbing, or alternatively by other material such as plastic, cotton, rayon, polyester or canvas. The divider 114 can be made of a webbed material or a solid material. In one embodiment, the divider 114 is attached to the right side perimeter 124 by placing an end of the divider 114 between the first non-absorbent panel 106 and the second non-absorbent panel 112 and using a method of attachment as described above. Further in this embodiment, the divider 114 is attached to the left side perimeter 126 by placing the other end of the divider 114 between the first non-absorbent panel 106 and the second non-absorbent panel 112 and using a method of attachment as described above.

In another embodiment, the divider 114 may be attached to the right side perimeter 124 and the left side perimeter 126 as described above, in addition the divider 114 may be attached at intervals between the right side perimeter 124 and the left side perimeter 126 to define at least one refrigerable device storage area 130. An attachment method as described above is used to define the at least one refrigerable device storage area 130. In one embodiment, where there is one continuous refrigerable device storage area 130, one refrigerable device 104 may be used. In another embodiment, where there is two or more refrigerable device storage areas 130, then the equal number of refrigerable devices 104 may be used.

The cosmetic case 100 may include one refrigerable device 104 or several refrigerable devices 104. The refrigerable device 104 is located between the second inner protective material layer 112B and the divider 114 in the at least one refrigerable device storage area 130. The refrigerable devices 104 have a thickness of between 0 and 1.5 inches, and preferably between 0.1 and 0.5 inches. Further, the refrigerable device 104 have a height and width of generally that of the cavity 110 as described above. The refrigerable devices 104 are made of a liquid-tight enclosure containing freezable liquid material. The refrigerable devices 104 may be removed from the carrying case 102 to enable them to be refrigerated in a freezer or refrigerator, and then later positioned back into the carrying case 102.

EXAMPLE

Cosmetic Case

A cosmetic case 100 includes a carrying case 102 having width dimensions of 7 inches and height dimensions of 4 inches and having a closure flap 108 height of 3 inches is made of nylon. The approximate depth of the carrying case is 1 inch when the closure flap 108 is attached to the first non-absorbent material panel 106. The carrying case 102 includes a first non-absorbent material panel 106 comprising a first inner protective material layer 106B and a first outer protective material layer 106A that are made of nylon. The carrying case 102 further includes a second non-absorbent material panel 112 comprising a second inner protective material layer 112B and a second outer protective material layer 112A that are made of nylon. The first non-absorbent material panel 106 further includes a first insulating material layer 204 made of cotton that is located between the first inner protective material layer 106B and the first outer protective material layer 106A. Further, the second non-absorbent material panel 112 includes a second inner insulating material layer 202 made of cotton that is located between the second inner protective material layer 112B and the second outer protective material layer 112A. The carrying case 102 further includes a divider 114 that is approximately 4 inches high and approximately 7 inches wide. The first non-absorbent panel 106, the second non-absorbent panel 112 and the divider 114 are stitched together on the right side perimeter 124 of the carrying case 102. The first non-absorbent panel 106, the second non-absorbent panel 112 and the divider 114 are stitched together on the left side perimeter 126 of the carrying case 102. The first non-absorbent panel 106, the second non-absorbent panel 112 and the divider 114 are folded together on the bottom perimeter 122 of the carrying case 102. The first non-absorbent panel 106 includes a first non-absorbent panel closure device 118 that is made of Velcro. The closure flap 108 includes a closure flap device 116 that is made of Velcro. The cosmetic case 100 further includes a refrigerable device 104 that fits between the divider 114 and the second non-absorbent panel 112. The cosmetic case is capable of carrying 6 lipstick tubes.

SUMMARY

The cosmetic case satisfies the need for a compact and thermodynamically efficient way of storing and transporting heat-sensitive cosmetics and the like, by incorporating, within a narrow confined space, non-absorbent protective material panels that include insulative material layers within, for the protection and cooled storage of cosmetics with minimal void space. The cosmetic case further includes removable refrigerable devices that are consistent with the narrow and compact design of the cosmetic case.

Although there has been described what is at present considered to be the preferred embodiments of the present invention, it will be understood that the invention can be embodied in other specific forms without departing from the spirit or essential characteristics thereof. The present embodiments are, therefore, to be considered in all aspects as illustrative and not restrictive. The scope of the invention is indicated by the appended claims rather than the foregoing description.

What is claimed:

1. A cosmetic case for refrigerated storage and transportation of heat-sensitive cosmetics and the like, comprising:

a carrying case, said carrying case comprising a first non-absorbent panel, and a second non-absorbent panel, wherein said first non-absorbent panel and said second non-absorbent panel substantially overlap and are attached around the perimeter of said first non-absorbent panel and said second non-absorbent panel, to form a cavity and an opening between said first non-absorbent panel and said second non-absorbent panel;

a mesh divider located within said cavity, said mesh divider defining a refrigerable device storage area and a cosmetic storage area; and a refrigerable device, said refrigerable device located within said refrigerable device storage area; wherein said heat-sensitive cosmetics are separated from said refrigerable device by only said mesh divider.

2. The cosmetic case of claim 1, wherein said first non-absorbent panel comprises a first inner protective material layer and a first outer protective material layer.

3. The cosmetic case of claim 1, wherein said second non-absorbent panel comprises a second inner protective material layer and a second outer protective material layer.

4. The cosmetic case of claim 2, wherein said first non-absorbent panel comprises a first insulating material layer located between said first inner protective material layer and said first outer protective material layer.

5. The cosmetic case of claim 3, wherein said second non-absorbent panel comprises a second insulating material layer located between said second inner protective material layer and said second outer protective material layer.

6. The cosmetic case of claim 1, wherein said second non-absorbent panel further includes a closure flap that overlaps said first non-absorbent panel to enclose said cavity.

7. The cosmetic case as in claim 2 or 3, wherein said inner protective material layer and said outer protective material layer comprise a material selected from the group consisting of polyester, nylon, Gortex, rubber, vinyl, plastic and canvas.

8. The cosmetic case as in claim 4 or 5, wherein said insulating material layer comprise a material selected from the group consisting of Thinsulate, Polartec, cotton, wool and polyester.

9. The cosmetic case of claim 1, wherein said refrigerable device comprises a liquid-tight enclosure containing freezable liquid material.

10. The cosmetic case of claim 6, wherein said closure flap further includes a closure flap device.

11. The cosmetic case of claim 1, wherein said first non-absorbent panel further includes a first non-absorbent panel closure device.

12. The cosmetic case as in claim 10 or 11, wherein said closure device is selected from the group comprising zippers, Velcro, buttons, buckles, laces, snaps and grommets.

13. The compact cosmetic cooler of claim 1, wherein said case height is between 1 and 8 inches.

14. The compact cosmetic cooler of claim 1, wherein said case width is between 2 and 10 inches.

15. A cosmetic case for refrigerated storage and transportation of heat-sensitive cosmetics and the like, comprising:

a carrying case, said carrying case comprising a first panel, said first panel including a first panel inner non-absorbent material layer and a first panel outer layer, and;

a second panel, said second panel including a second panel inner non-absorbent material layer and a second panel outer layer, wherein said first panel inner non-absorbent material layer and said second panel inner non-absorbent material layer face each other and substantially overlap and are attached around the perimeter of said first panel and said second panel to form a cavity and an opening between said first panel and said second panel;

a mesh divider located within said cavity, said mesh divider defining a refrigerable device storage area and a cosmetic storage area;

a refrigerable device, said refrigerable device located within said refrigerable device storage area; and a closure flap attached with said second panel, said closure flap overlaps said first panel to enclose said cavity; wherein said heat-sensitive cosmetics are separated from said refrigerable device by only said mesh divider.

16. The cosmetic case of claim 15, wherein said first panel comprises an insulating material layer located between said first panel inner non-absorbent material layer and said first panel outside layer.

17. The cosmetic case of claim 15, wherein said second panel comprises an insulating material layer located between said second panel inner non-absorbent material layer and said second panel outside layer.

18. A cosmetic case for refrigerated storage and transportation of heat-sensitive cosmetics and the like, comprising:

a first panel comprising:

a.) a first panel inner non-absorbent material layer;

b.) a first panel outer layer; and c.) an insulating material layer located therebetween;

a second panel comprising:

a.) a second panel inner non-absorbent material layer;

b.) a second panel outer layer; and c.) an insulating material located therebetween, wherein said first panel inner non-absorbent material layer and said second panel inner non-absorbent material layer face each other and substantially overlap and are attached around the perimeter of said first panel and said second panel to form a cavity and an opening between said first panel and said second panel;

a mesh divider located within said cavity, said mesh divider defining a refrigerable device storage area and plurality of individual cosmetic storage areas;

a refrigerable device, said refrigerable device located within said refrigerable device storage area; and a closure flap attached with said second panel, said closure flap overlaps said first panel to enclose said cavity; wherein said heat-sensitive cosmetics are separated from said refrigerable device by only said mesh divider.

* * * * *